US009301076B2

(12) United States Patent
Mizuta

(10) Patent No.: US 9,301,076 B2
(45) Date of Patent: Mar. 29, 2016

(54) GAME SYSTEM, GAME PROCESS CONTROL METHOD, GAME APPARATUS, AND COMPUTER-READABLE NON-TRANSITORY STORAGE MEDIUM HAVING STORED THEREIN GAME PROGRAM

(71) Applicant: NINTENDO CO., LTD., Kyoto (JP)

(72) Inventor: Masato Mizuta, Kyoto (JP)

(73) Assignee: NINTENDO CO., LTD., Kyoto (JP)

( * ) Notice: Subject to any disclaimer, the term of this patent is extended or adjusted under 35 U.S.C. 154(b) by 445 days.

(21) Appl. No.: 13/868,479

(22) Filed: Apr. 23, 2013

(65) Prior Publication Data

US 2014/0126754 A1 May 8, 2014

(30) Foreign Application Priority Data

Nov. 5, 2012 (JP) ..... 2012-243619

(51) Int. Cl.
*H04R 5/02* (2006.01)
*H04S 7/00* (2006.01)

(52) U.S. Cl.
CPC ..... *H04S 7/301* (2013.01); *H04S 2400/11* (2013.01); *H04S 2400/13* (2013.01)

(58) Field of Classification Search
CPC .. H04S 2400/11; H04S 2400/13; H04S 7/301
USPC ..... 381/1, 17, 18, 61, 300, 306, 307, 310; 700/94; 463/25, 30, 32, 35, 42, 43
See application file for complete search history.

(56) References Cited

U.S. PATENT DOCUMENTS 8,760,441 B2 * 6/2014 Kohara ..... G06F 1/1624 345/1.1
9,041,735 B2 * 5/2015 Choi ..... G06F 3/0481 345/2.1
2004/0152513 A1 8/2004 Shimizu
2005/0281410 A1 * 12/2005 Grosvenor ..... H04H 60/47 381/61
2007/0270226 A1 * 11/2007 York ..... A63F 13/00 463/43
2009/0082095 A1 * 3/2009 Walker ..... G07F 17/32 463/25
2009/0221374 A1 * 9/2009 Yen ..... A63F 13/06 463/42
2009/0282335 A1 * 11/2009 Alexandersson . G06F 17/30749 715/716
2012/0050507 A1 * 3/2012 Keys ..... H04N 13/0438 348/56

FOREIGN PATENT DOCUMENTS

JP 2004-223110 8/2004

* cited by examiner

*Primary Examiner* — Vivian Chin
*Assistant Examiner* — Friedrich W Fahnert
(74) *Attorney, Agent, or Firm* — Nixon & Vanderhye, P.C.

(57) ABSTRACT

A predetermined sound is reproduced at a position of a sound source object. The sound is received by a plurality of virtual microphones, and a sound volume of the sound received at each virtual microphone is calculated. In addition, a localization of the sound received at the virtual microphone is also calculated. Furthermore, a localization of a sound to be outputted to a sound output section is calculated on the basis of the loudness and the localization of the sound received at each virtual microphone. The sound of the sound source object is outputted to the sound output section on the basis of the localization.

16 Claims, 10 Drawing Sheets

VIRTUAL SPACE COORDINATE SYSTEM

VIRTUAL SPACE COORDINATE SYSTEM

GAME SYSTEM, GAME PROCESS CONTROL METHOD, GAME APPARATUS, AND COMPUTER-READABLE NON-TRANSITORY STORAGE MEDIUM HAVING STORED THEREIN GAME PROGRAM

CROSS REFERENCE TO RELATED APPLICATION

The disclosure of Japanese Patent Application No. 2012-243619, filed on Nov. 5, 2012, is incorporated herein by reference.

FIELD

The exemplary embodiments disclosed herein relate to a game system, a game process control method, a game apparatus, and a computer-readable non-transitory storage medium having stored therein a game program, and more particularly relate to a game system, a game process control method, a game apparatus, and a computer-readable non-transitory storage medium having stored therein a game program, which include a sound output section for outputting a sound based on an audio signal and which represents a virtual three-dimensional space in which a plurality of virtual microphones and at least one sound source object associated with predetermined audio data are located.

BACKGROUND AND SUMMARY

Hitherto, a game is known in which when a plurality of players participate in the game and play the game on a display screen displayed on a shared display means, the screen is split into sections. In the conventional art, with regard to reproduction of a sound effect and the like in such a game which is played by multiple players with the display screen split into sections, the sound effect is generally reproduced merely at a center without particularly calculating a localization of a sound from a sound source for the sound effect. Alternatively, a process of reproducing sounds whose number is equal to the number of sections into which the screen is split is performed in some cases.

For example, a case is considered in which, in a game set in a virtual three-dimensional space, a process of splitting a screen into sections for playing the game as described above is performed. In this case, for example, when sound is reproduced merely at a center with regard to localization, it is difficult for each player to aurally determine whether a certain sound source (e.g., an enemy character emitting a predetermined sound) present within the virtual three-dimensional space is close to or distant from the position of a character operated by each player. In addition, even when sounds whose number is equal to the number of sections into which the screen is split are reproduced, the sound from the same sound source is reproduced many times. Thus, a process becomes complicated, or the same sounds are outputted in an overlapping manner to excessively increase the sound volume.

Therefore, it is a feature of the exemplary embodiments to provide a game system, a game process control method, a game apparatus, and a computer-readable non-transitory storage medium having stored therein a game program, which allow each player to easily aurally recognize a sound source close to a character operated by each player in a game that is played with a screen split into sections. It is noted that the computer-readable storage medium include, for example, magnetic media such as a flash memory, a ROM, and a RAM, and optical media such as a CD-ROM, a DVD-ROM, and a DVD-RAM.

The feature described above is attained by, for example, the following configuration.

A configuration example is a game system which includes a sound output section configured to output a sound based on an audio signal and which represents a virtual three-dimensional space in which a plurality of virtual microphones and at least one sound source object associated with predetermined audio data are located. The game system includes a sound reproduction section, a received sound volume calculator, a first localization calculator, a second localization calculator, and a sound output controller. The sound reproduction section is configured to reproduce a sound based on the predetermined audio data associated with the sound source object, at a position of the sound source object in the virtual three-dimensional space. The received sound volume calculator is configured to calculate, for each of the plurality of virtual microphones, a magnitude of a sound volume of the sound, reproduced by the sound reproduction section, at each virtual microphone when the sound is received by each virtual microphone. The first localization calculator is configured to calculate, for each of the plurality of virtual microphones, a localization of the sound, reproduced by the sound reproduction section, as a first localization when the sound is received by each virtual microphone. The second localization calculator is configured to calculate a localization of a sound to be outputted to the sound output section as a second localization on the basis of the magnitude of the sound volume of the sound regarding the sound source object at each virtual microphone which is calculated by the received sound volume calculator and the localization at each virtual microphone which is calculated by the first localization calculator. The sound output controller is configured to generate an audio signal regarding the sound source object on the basis of the second localization calculated by the second localization calculator and to output the audio signal to the sound output section.

According to the above configuration example, when a plurality of the virtual microphones which receive the sound from the single sound source object are present within the virtual three-dimensional space, it is possible to perform sound representation that allows a sense of distance between each virtual microphone and the sound source object to be easily and aurally grasped.

Additionally, the game system may further include a display section; and a display controller configured to split a display area included in a display screen displayed on the display section into split regions whose number is equal to the number of players who participate in a game and to display an image representing a situation within the virtual three-dimensional space, on the split region assigned to each player. Furthermore, each virtual microphone may be associated with any of the split regions and may have a sound localization range corresponding to the associated split region, and the first localization calculator may calculate the first localization by using the sound localization range corresponding to the split region associated with each virtual microphone. Moreover, the display controller may split the display area such that the split regions are aligned along a lateral direction.

According to the above configuration example, in a game that is played with a screen being split, a player is allowed to easily recognize a sound close to a character operated by the player.

Additionally, the second localization calculator may calculate the second localization such that a weight assigned to the first localization at the virtual microphone having the greatest magnitude of the sound volume which is calculated by the received sound volume calculator is increased.

According to the above configuration example, it is possible to perform sound representation that allows a sense of distance between each of the plurality of virtual microphones and the sound source object to be easily and aurally grasped.

Additionally, the game system may further include an output sound volume setter configured to set, as a sound volume of a sound to be outputted to the sound output section, the greatest sound volume among the sound volume at each virtual microphone which is calculated by the received sound volume calculator. The sound output controller may output the sound based on the audio signal with the sound volume set by the output sound volume setter.

According to the above configuration example, it is possible to perform sound representation that allows a sense of distance between the virtual microphone and the sound source object to be easily and aurally grasped.

Additionally, a plurality of the sound source objects may be located in the virtual three-dimensional space. Furthermore, the received sound volume calculator may calculate, for each virtual microphone, a magnitude of a sound volume of a sound regarding each of the plurality of the sound source objects at each virtual microphone. The first localization calculator may calculate, for each virtual microphone, the first localization regarding each of the plurality of the sound source objects. The second localization calculator may calculate, for each virtual microphone, the second localization regarding each of the plurality of the sound source objects. The sound output controller may generate an audio signal based on the second localization regarding each of the plurality of the sound source objects.

According to the above configuration example, when there are a plurality of the sound source objects, a sense of distance between the virtual microphone and each sound source object is allowed to be easily and aurally grasped.

Additionally, the sound output section may be a stereo speaker, and each of the first localization calculator and the second localization calculator may calculate a localization in a right-left direction when a player facing the sound output section sees the sound output section.

According to the above configuration example, for example, in a game in which a display area of a screen is split in the right-left direction, a sense of distance between the sound source object and the virtual microphone (or a character operated by the player) is allowed to be easily and aurally grasped for each split region.

Additionally, the sound output section may be a surround speaker, and each of the first localization calculator and the second localization calculator may calculate a localization in a right-left direction and a localization in a forward-rearward direction when a player facing the sound output section sees the sound output section.

According to the above configuration example, a sense of distance in the depth direction between the sound source object and the virtual microphone is allowed to be easily and aurally grasped.

According to the exemplary embodiments, in a game that is played with a screen being split, each player is allowed to easily grasp a sense of distance between a sound source object and a character operated by each player, and thus the fun of the game is allowed to be enhanced further.

DETAILED DESCRIPTION OF NON-LIMITING EXAMPLE EMBODIMENTS

A game system according to one embodiment will be described with reference to FIG. 1.

Figure 1:
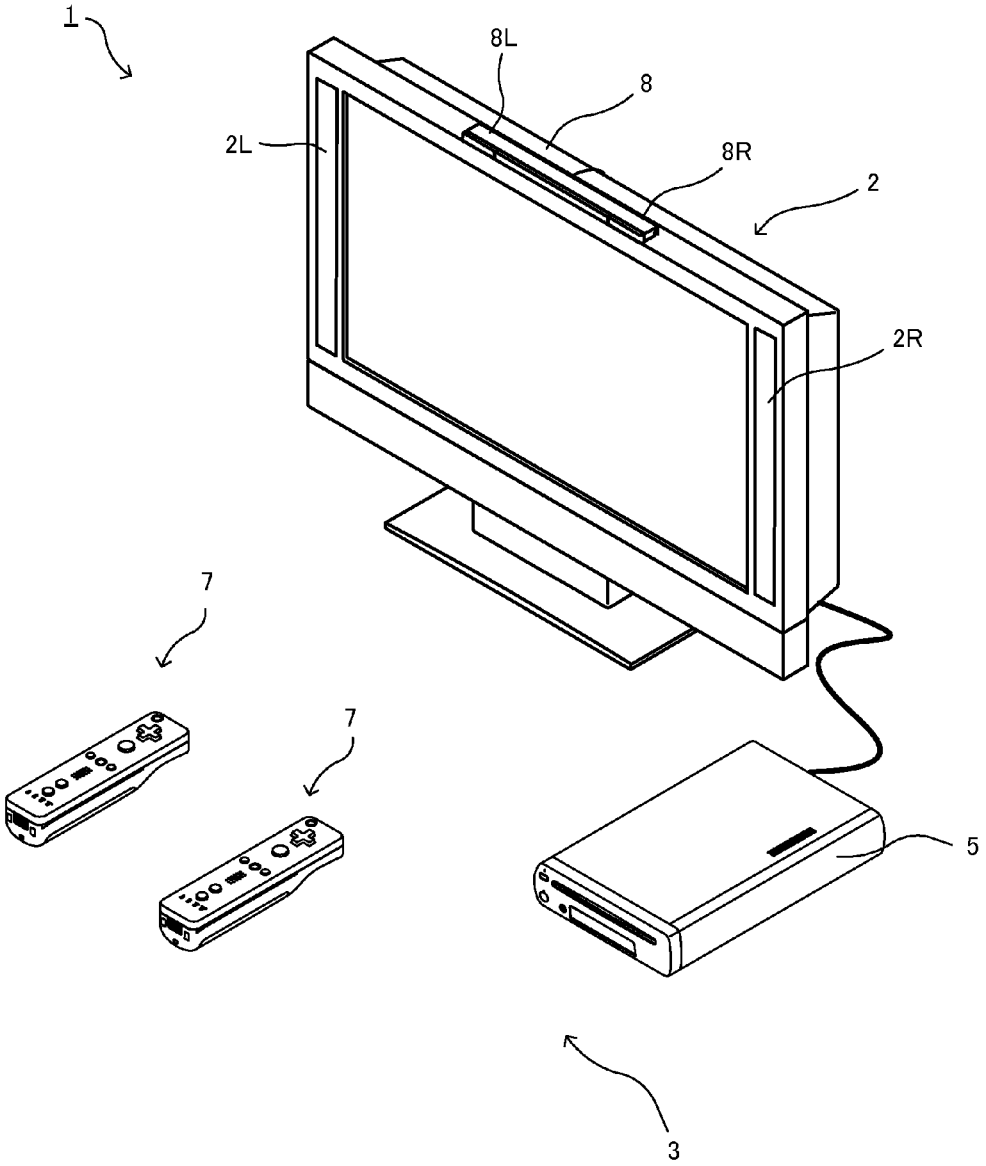
FIG. 1 is an external view showing a non-limiting example of a game system 1 according to one embodiment.

In FIG. 1, a game system 1 includes a household television receiver (hereinafter, referred to as monitor) 2, which is an example of a display section, and a stationary game apparatus 3 connected to the monitor 2 via a connection cord. In addition, the game apparatus 3 includes a game apparatus body 5, a plurality of controllers 7, and a marker section 8.

The monitor 2 displays game images outputted from the game apparatus body 5. The monitor 2 includes speakers 2L and 2R that are stereo speakers. The speakers 2L and 2R output game sounds outputted from the game apparatus body 5. Although the monitor 2 includes these speakers in the embodiment, an external speaker may be additionally connectable to the monitor 2 in another embodiment. In addition, the marker section 8 is provided in the vicinity of the screen of the monitor 2 (on the upper side of the screen in FIG. 1). The marker section 8 includes two markers 8R and 8L at both ends thereof. Specifically, the marker 8R is composed of one or more infrared LEDs and outputs infrared light forward from the monitor 2 (the same applies to the marker 8L). The marker section 8 is connected to the game apparatus body 5, and the game apparatus body 5 is able to control each LED of the marker section 8 to be on or off.

The game apparatus body 5 performs a game process or the like on the basis of a game program or the like stored in an optical disc that is readable by the game apparatus body 5.

Each controller 7 provides, to the game apparatus body 5, operation data representing the content of an operation performed on the controller 7. Each controller 7 and the game apparatus body 5 are connected via wireless communication.

Figure 2:
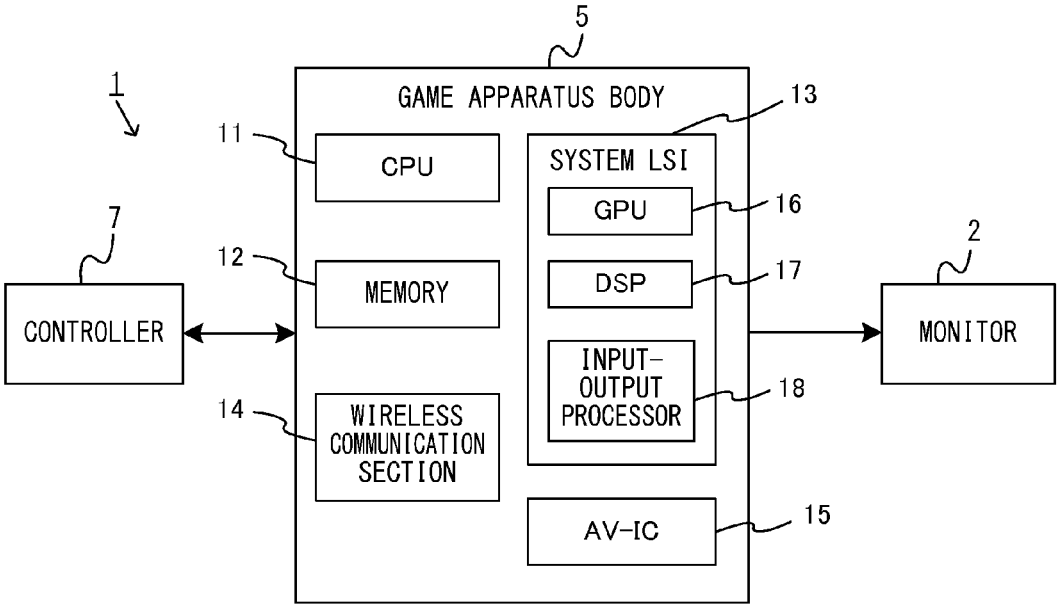
FIG. 2 is a function block diagram showing a non-limiting example of a game apparatus body 5 in FIG. 1.

FIG. 2 is a block diagram of the game apparatus body 5. In FIG. 2, the game apparatus body 5 is an example of an information processing apparatus. In the present embodiment, the game apparatus body 5 includes a CPU (control section) 11, a memory 12, a system LSI 13, a wireless communication section 14, an AV-IC (Audio Video-Integrated Circuit) 15, and the like.

The CPU 11 executes a predetermined information processing program using the memory 12, the system LSI 13, and the like. By so doing, various functions (e.g., a game process) in the game apparatus 3 are realized.

The system LSI 13 includes GPU (Graphics Processor Unit) 16, a DSP (Digital Signal Processor) 17, an input-output processor 18, and the like.

The GPU 16 generates an image in accordance with a graphics command (image generation command) from the CPU 11.

The DSP 17 functions as an audio processor and generates audio data by using sound data and sound waveform (tone) data stored in the memory 12.

The input-output processor 18 performs transmission and reception of data to and from the controllers 7 via the wireless communication section 14. In addition, the input-output processor 18 receives, via the wireless communication section 14, operation data and the like transmitted from the controllers 7, and stores (temporarily) the operation data and the like in a buffer area of the memory 12.

Image data and audio data generated in the game apparatus body 5 are read by the AV-IC 15. The AV-IC 15 outputs the read image data to the monitor 2 via an AV connector (not shown), and outputs the read audio data to the speakers 2L and 2R of the monitor 2 via the AV connector. By so doing, an image is displayed on the monitor 2, and sound is outputted from the speakers 2L and 2R.

Figure 3:
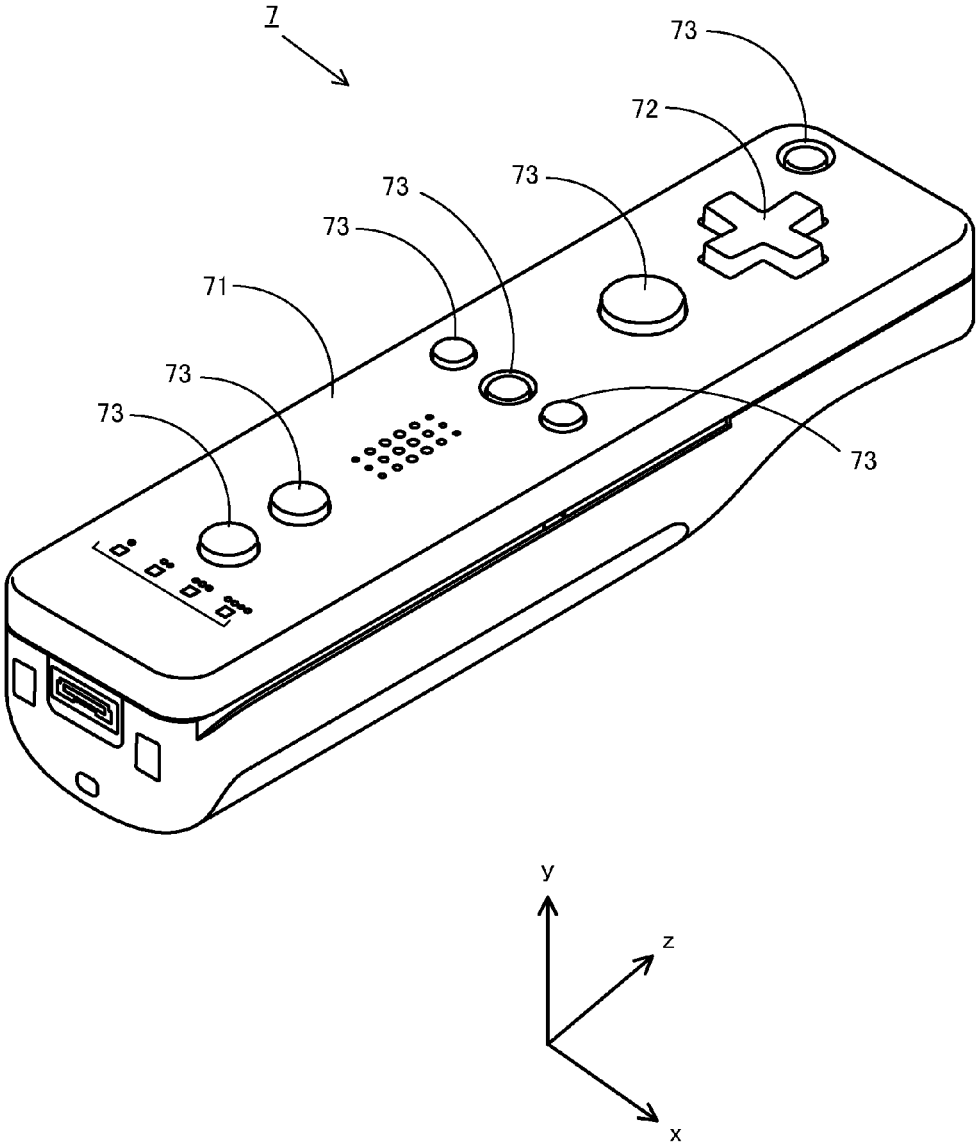
FIG. 3 is a diagram showing a non-limiting example of the external configuration of a controller 7 in FIG. 1.

FIG. 3 is a perspective view showing the external configuration of each controller 7. In FIG. 3, the controller 7 includes a housing 71 formed, for example, by plastic molding. In addition, the controller 7 includes a cross key 72, a plurality of operation buttons 73, and the like as an operation section (an operation section 31 shown in FIG. 4). The controller 7 also includes a motion sensor. A player can perform game operations by pressing each button provided in the controller 7 and moving the controller 7 to change its position and/or attitude.

Figure 4:
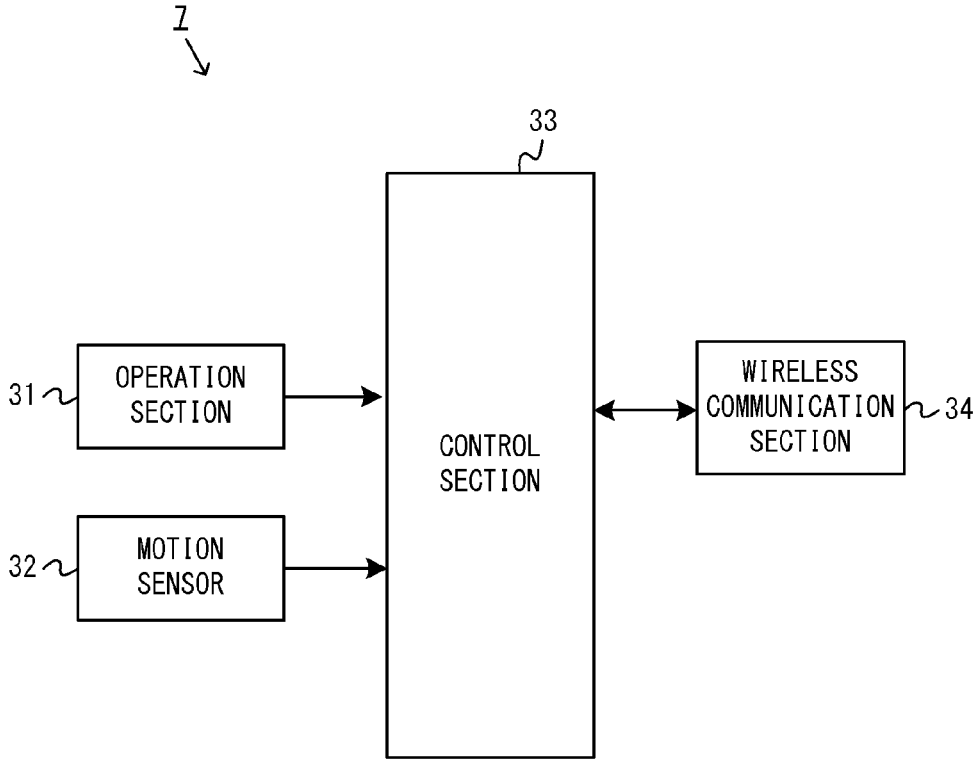
FIG. 4 is a block diagram showing a non-limiting example of the internal configuration of the controller 7.

FIG. 4 is a block diagram showing the electrical configuration of each controller 7. As shown in FIG. 4, the controller 7 includes the above-described operation section 31. In addition, the controller 7 includes the motion sensor 32 for detecting the attitude of the controller 7. In the present embodiment, an acceleration sensor and a gyro-sensor are provided as the motion sensor 32. The acceleration sensor is able to detect acceleration in three axes, namely, an x-axis, a y-axis, and a z-axis. The gyro-sensor is able to detect angular velocities about the three axes, namely, the x-axis, the y-axis, and the z-axis.

In addition, the controller 7 includes a wireless communication section 34 which is able to perform wireless communication with the game apparatus body 5. In the present embodiment, wireless communication is performed between the controller 7 and the game apparatus body 5. However, communication may be performed therebetween via a wire in another embodiment.

Moreover, the controller 7 includes a control section 33 which controls an operation of the controller 7. Specifically, the control section 33 receives output data from each input section (the operation section 31 and the motion sensor 32) and transmits the output data as operation data to the game apparatus body 5 via the wireless communication section 34.

Next, an outline of a process performed by the system according to the present embodiment will be described with reference to FIGS. 5 to 11.

In the present embodiment, the following game process of a game is assumed. The game is a game that can be played simultaneously by multiple players. In the present embodiment, as an example, a case will be described in which the game is played simultaneously by two players. In addition, the game is also a game that allows each player character to freely move around in a virtual three-dimensional space (hereinafter, referred to merely as virtual space). Each player character has a gun and is able to make an attack with the gun. In such a game, each player can perform a versus play or can perform a cooperative play for eliminating a predetermined enemy character.

Figure 5:
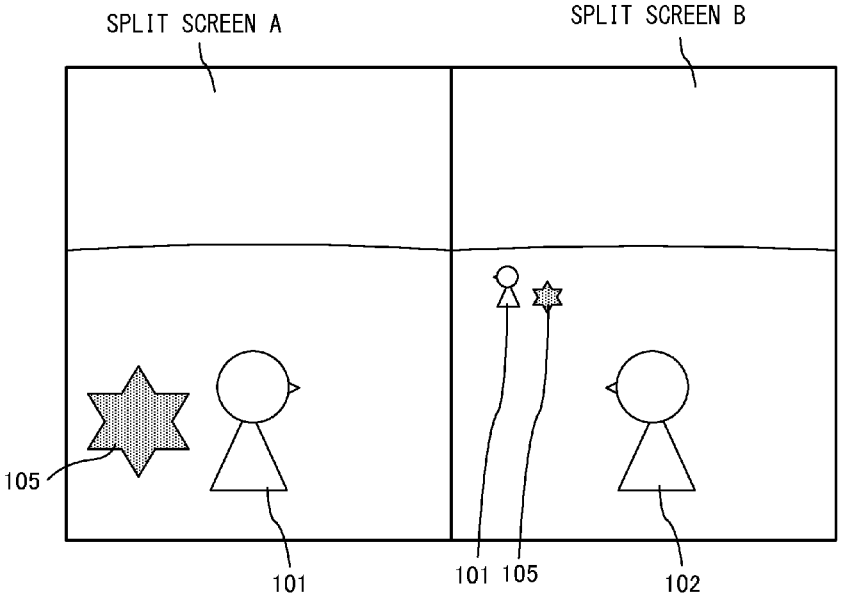
FIG. 5 shows a non-limiting example of a game screen.

FIG. 5 is a diagram showing an example of a game screen of the game. In the game, the screen is split into left-half and right-half screens with the center thereof as a boundary. In FIG. 5, the left-half screen is assigned as a screen for a first player (hereinafter, referred to as player A), and the right-half screen is assigned as a screen for a second player (hereinafter, referred to as player B).

A player character 101, which is an operation target of the player A, and a sound source object 105 are displayed on the screen for the player A (hereinafter, referred to as split screen A). In addition, the right side of the player character 101 is displayed on the split screen A. Moreover, the sound source object 105 is located on the left rear side of the player character 101. It is noted that the sound source object is an object defined as an object that is able to emit a predetermined sound. Meanwhile, a player character 102, which is an operation target of the player B, is displayed on the screen for the player B (hereinafter, referred to as split screen B). In addition, the player character 101 and the sound source object 105 are displayed (far from the player character 102). It is noted that the left side of the player character 102 is displayed on the split screen B.

Figure 6:
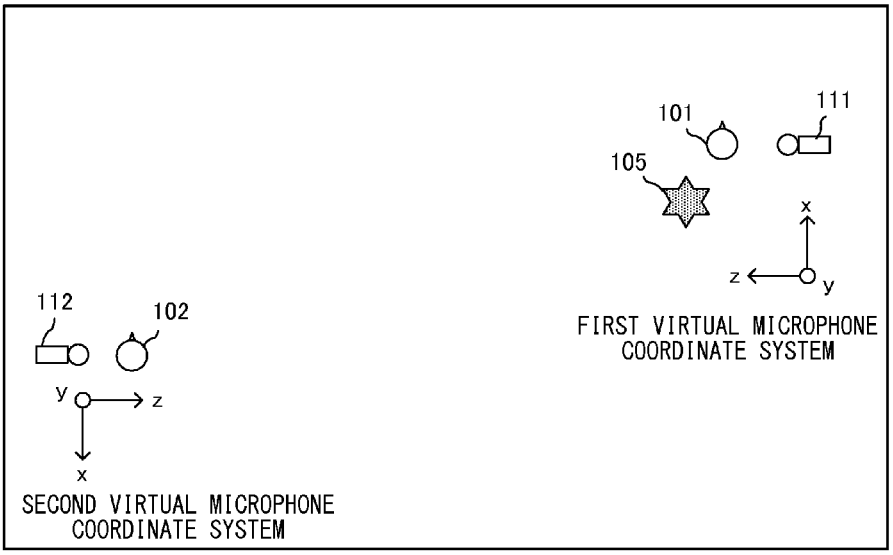
FIG. 6 is a diagram showing a positional relation of each object within a virtual space.
Figure 6:
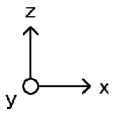

FIG. 6 is a diagram showing a positional relation of each object within the virtual space in the above-described state of FIG. 5. In addition, FIG. 6 shows a bird's eye view of the virtual space. In FIG. 6, both of the player characters 101 and 102 face in a z-axis positive direction in a virtual space coordinate system. In addition, a first virtual microphone 111 is located on the right side of the player character 101 in FIG. 6. Moreover, a first virtual camera (not shown) is also located at the same position as that of the first virtual microphone 111. An image captured by the first virtual camera is displayed on the split screen A. The first virtual microphone 111 is used for the split screen A. Similarly, a second virtual microphone 112 is located on the left side of the player character 102. In addition, a second virtual camera (not shown) is also located at this position. An image captured by the second virtual camera is displayed on the split screen B. The second virtual microphone 112 is used for the split screen B. It is noted that in principle, these virtual cameras and virtual microphones are moved in accordance with movement of each player character.

In FIG. 6, the player character 101 is located substantially at the upper right location in FIG. 6. Meanwhile, the player character 102 is located at a location near the lower left in FIG. 6. The sound source object 105 is located near (on the left rear side of) the player character 101. In other words, a positional relation is established in which the sound source object 105 is present nearby when being seen from the player character 101, and is present far when being seen from the player character 102.

In the above-described positional relation, a case will be considered in which a sound emitted from the sound source object 105 is represented (outputted) by the speakers 2L and 2R. In the present embodiment, the screen is split into two screens as described above, and the virtual microphone is provided for each screen. Thus, a process of receiving the sound from the sound source object 105 with each virtual microphone (a process of performing sound field calculation (sound volume and localization) in which the sound is regarded as being heard through the virtual microphone) is performed. As a result, the sound emitted from the sound source object 105 reaches each virtual microphone with different sound volumes and localizations. Here, with regard to a physical speaker, only a pair of the speakers 2L and 2R is present in the present embodiment. Thus, in the present embodiment, the sounds of the sound source object 105 obtained by the two virtual microphones are eventually represented collectively as a single sound. In this case, in the present embodiment, sound representation is performed in such a manner that the positional relation between each player character and the sound source object 105 in each screen is reflected therein. Specifically, sound output is performed in such a manner that sound localization is biased to the split screen side associated with the virtual microphone closer to the sound source (the virtual microphone that picks up a louder sound). By so doing, the sound emitted from the sound source is allowed to be heard in a natural manner, even with a single sound without reproducing, as the sound from the sound source, sounds whose number is equal to the number of the split screens.

Figure 7:
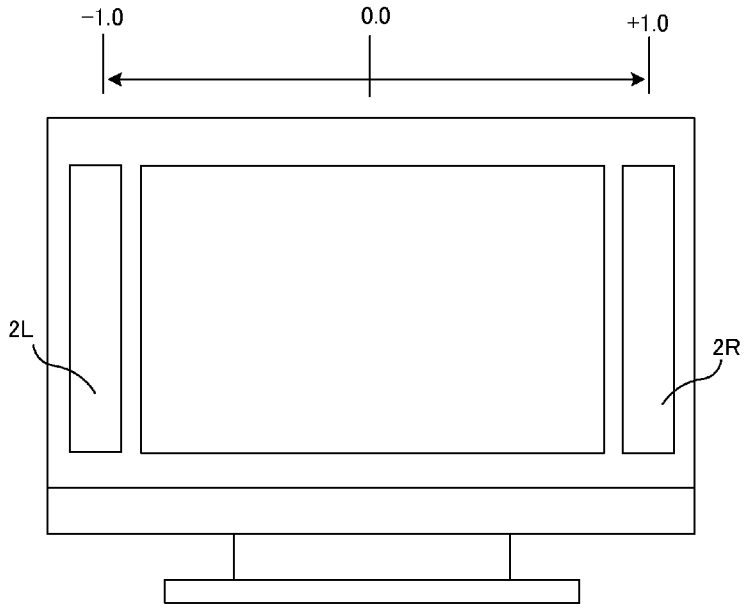
FIG. 7 is a diagram showing a non-limiting example of a localization range.

For the sound representation as described above, the following process is generally performed in the present embodiment. First, with regard to the speakers 2L and 2R which are a pair of stereo speakers of the monitor 2, a sound localization range is defined, for example, to be −1.0 to +1.0 (see FIG. 7). In FIG. 7, at −1.0, it is in a state where sound is heard only from the speaker 2L (a state where the sound volume balance is biased left). At +1.0, it is in a state where sound is heard only from the speaker 2R (a state where the sound volume balance is biased right). At 0.0, it is in a state where sound is heard from the center (the right and left sound volumes are equally balanced).

Figure 8:
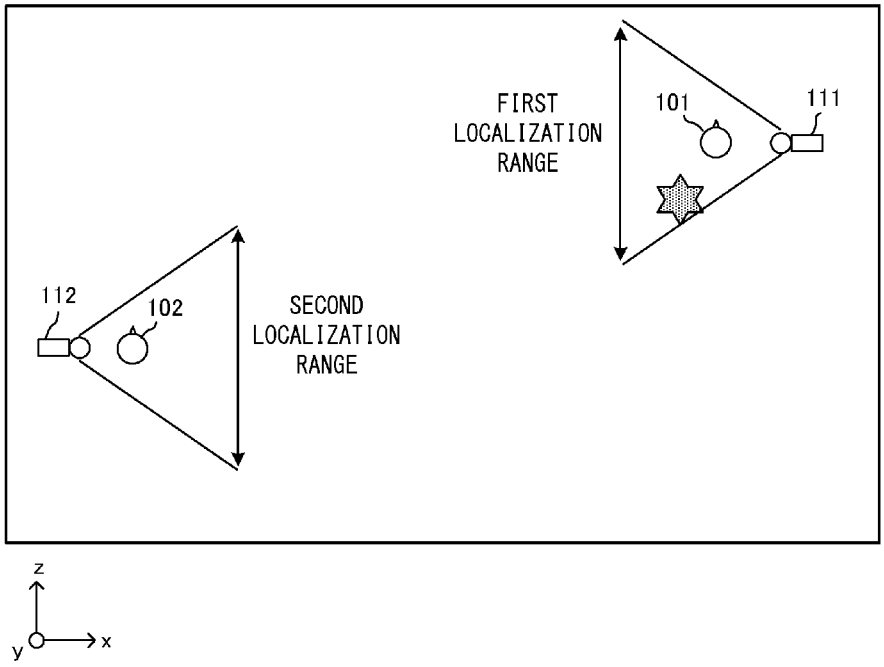
FIG. 8 is a diagram showing a localization for each virtual microphone.

Meanwhile, in the present embodiment, the two virtual microphones are provided as described above. This means that there are two sound localization ranges corresponding to the two virtual microphones, respectively. FIG. 8 is a schematic diagram showing a localization corresponding to each virtual microphone. FIG. 8 shows that there is a first localization range for the first virtual microphone 111 and there is a second localization range for the second virtual microphone 112. It is noted that for simplification of explanation, with regard to localization, FIG. 8 shows only the ranges in the right-left direction, and illustration regarding spreading and depth of sound is omitted therein.

Figure 9:
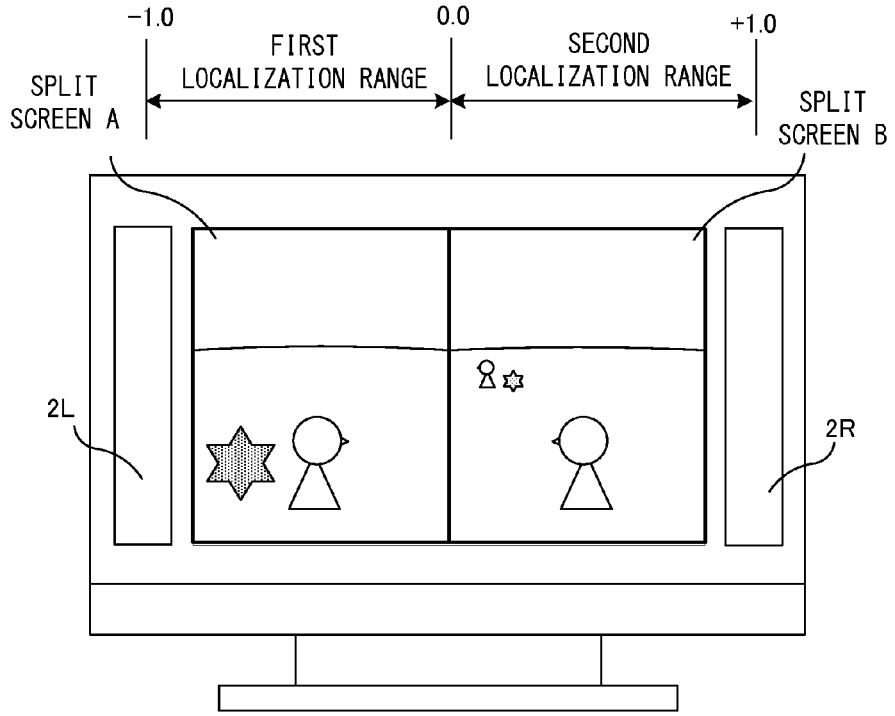
FIG. 9 is a diagram showing correspondence between each split screen and a localization.

The first localization range corresponds to the split screen A. In addition, the second localization range corresponds to the split screen B. FIG. 9 is a schematic diagram showing correspondence between these two localization ranges and the split screens. In other words, with regard to the split screen A, the range of −1.0 to 0.0 in FIG. 7 corresponds to the first localization range, and with regard to the split screen B, the range of 0.0 to +1.0 in FIG. 7 corresponds to the second localization range.

On the assumption of the above-described correspondence relation of localization, the following process is performed. First, a sound reception process with each virtual microphone is performed. Specifically, for each virtual microphone, the loudness of a sound received by each virtual microphone (hereinafter, referred to as received sound volume) is calculated on the basis of the distance between each virtual microphone and the sound source object 105 and the like.

Next, while the positional relation between each virtual microphone and the sound source object 105 is taken into consideration, a sound localization regarding the sound source object is calculated by the same method as that for the case where a game screen is displayed as a single screen. In other words, a localization is calculated on the assumption of the localization range shown in FIG. 7. For example, a localization is calculated by the same method as that for the case of a single-player play. In addition, the positional relation taken into consideration includes whether the sound source object 105 is located on the right side or the left side when been seen from the virtual microphone.

Next, the calculated localization (a value within the range of −1.0 to +1.0) is corrected in consideration of the above-described split screens. Taking the split screens shown in FIG. 7 as an example, in the case of the first virtual microphone 111 (the split screen A), a value within the range of −1.0 to +1.0 is corrected so as to correspond to a value within the range of −1.0 to 0.0. In the case of the second virtual microphone 112, a value within the range of −1.0 to +1.0 is corrected so as to correspond to a value within the range of 0.0 to +1.0. Hereinafter, the localization after the correction is referred to "correction localization".

For example, a correction localization is calculated by dividing a localization calculated on the assumption of single-screen display, by 2 (i.e., the number of screens into which the screen is split) and adding, to the resultant value, a localization corresponding to the center of each of the above-described split screens. For example, in a process for the player A (split screen A), when a localization calculated on the assumption of the single-screen case is +0.5, a correction localization is $(0.5/2)+(-0.5)=-0.25$.

As described above, for each of the first virtual microphone 111 and the second virtual microphone 112, the received sound volume and the correction localization of the sound from the sound source object 105 are obtained. Then, on the basis of these two, final localization and sound volume are determined. Specifically, final localization and sound volume are determined such that a great weight is assigned to the sound localization for the screen (virtual microphone) in which the received sound volume from the sound source object 105 is greater (the details will be described later).

Figure 10:
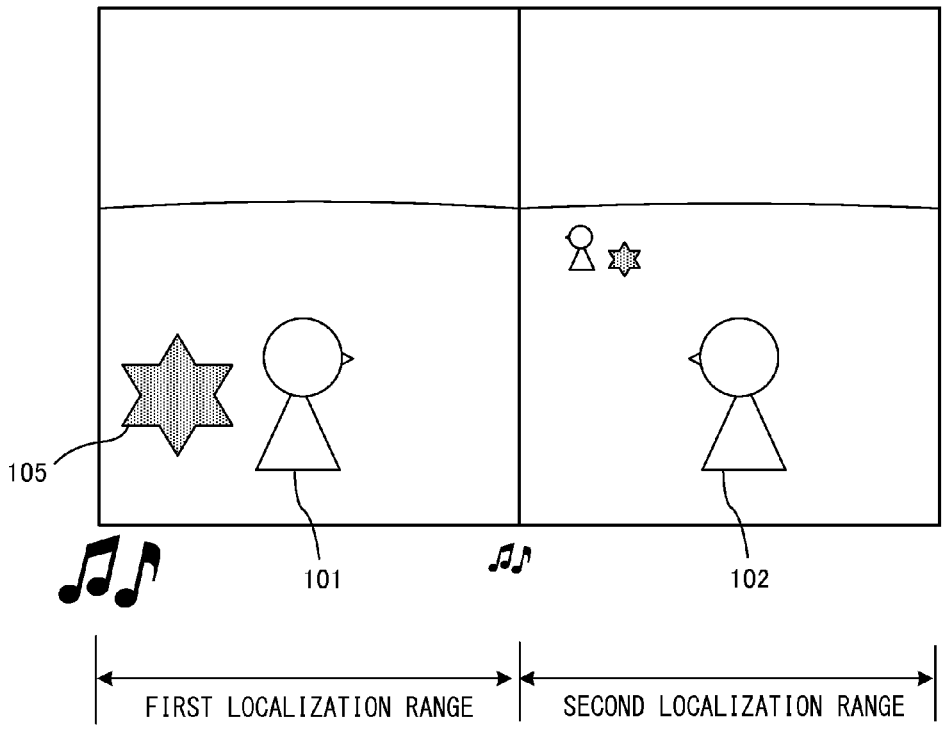
FIG. 10 shows a non-limiting example of a game screen.

With the above-described process, even when sounds received by a plurality of virtual microphones from one sound source are outputted as a single sound, the sound is allowed to be heard in a natural manner. In addition, each player is allowed to easily and aurally grasp a sense of distance and a sense of perspective between each player character and the sound source object 105. For example, it is assumed that no sound reaches the second virtual microphone 112 from the sound source object 105 in the above-described state of FIGS. 5 and 6. In this case, a state is provided in which sound is heard within the localization range for the split screen A as shown in FIG. 10. Particularly, in the case of FIG. 10, a state is provided in which the sound of the sound source object 105 is heard mainly from the speaker 2L. Thus, it is made easy for the player B to aurally recognize that the sound source object 105 is far away from the own character.

Figure 11:
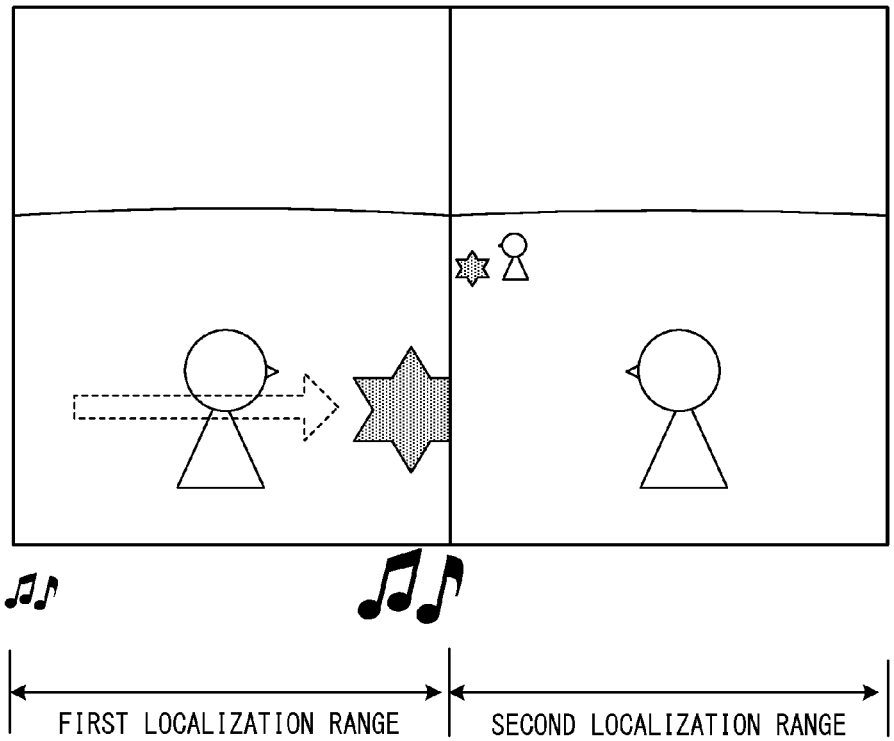
FIG. 11 shows a non-limiting example of a game screen.

In addition, for example, in the state of FIG. 10, a case will be considered in which the sound source object 105 moves toward the right side of the screen. In such a case, as shown in FIG. 11, the localization is adjusted within the first localization range such that the sound of the sound source object 105 moves from the left side of the screen to near the center of the screen. Then, when the sound source object 105 disappears from (is not displayed on) the split screen A, the movement of the sound stops at the center of the screen, and rightward movement of the sound therefrom does not occur. In other words, in such a case, the sound of the sound source object 105 moves from the left side of the screen (the speaker 2L) to near the center of the monitor 2. Then, representation is performed such that, as the sound source object 105 moves away from the player character 101, the sound gradually fades out. In other words, in a state where the sound of the sound source object 105 reaches only the first virtual microphone 111, representation is performed such that the localization of the sound from the sound source object 105 is changed only within the range for the left half of the monitor 2 (the first localization range).

Next, an operation of the system 1 for realizing the above-described game process will be described in detail with reference to FIGS. 12 to 14.

Figure 12:
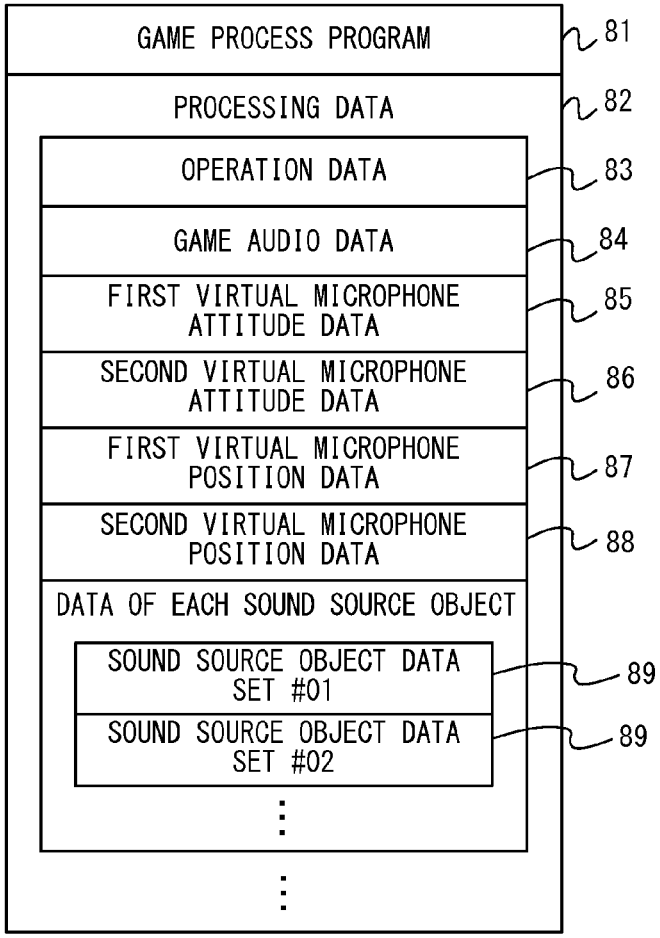
FIG. 12 shows a memory map of a memory 12.
Figure 13:
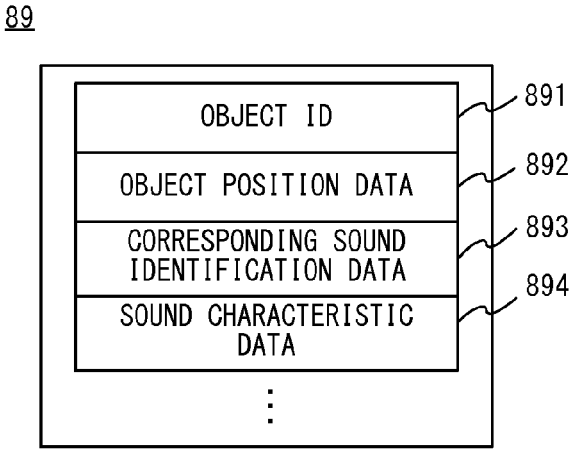
FIG. 13 shows a non-limiting example of the configuration of a sound source object data set 89.

FIG. 12 shows an example of various data stored in the memory 12 of the game apparatus body 5 when the above-described game process is performed.

A game process program 81 is a program for causing the CPU 11 of the game apparatus body 5 to perform the game process for realizing the above-described game. The game process program 81 is, for example, loaded from an optical disc into the memory 12.

Processing data 82 is data used in the game process performed by the CPU 11. The processing data 82 includes operation data 83, game audio data 84, first virtual microphone attitude data 85, second virtual microphone attitude data 86, first virtual microphone position data 87, second virtual microphone position data 88, and a plurality of sound source object data sets 89. In addition, data representing the attitude of each virtual camera, data of each player character, and data of various other objects are also included, but omitted in the drawing.

The operation data 83 is operation data transmitted periodically from each controller 7. The operation data 83 includes data representing a state of an input on the operation section 31 and data representing the content of an input on the motion sensor 32.

The game audio data 84 is data on which a game sound emitted by the sound source object 105 is based. The game audio data 84 includes sound effects and music data sets that are associated with the sound source object 105. In addition, the game audio data 84 also includes various sound effects and music data sets that are not associated with the sound source object 105.

The first virtual microphone attitude data 85 is data representing the attitude of the first virtual microphone 111. The second virtual microphone attitude data 86 is data representing the attitude of the second virtual microphone 112. The attitude of each virtual microphone is changed as appropriate on the basis of a moving operation or the like for each player character. In the present embodiment, the attitude (particularly, the direction) of each virtual microphone is controlled so as to coincide with the attitude (direction) of the corresponding virtual camera.

The first virtual microphone position data 87 is data representing the position of the first virtual microphone 111 within the virtual space. The second virtual microphone position data 88 is data representing the position of the second virtual microphone 112 within the virtual space. The position of each virtual microphone is changed as appropriate in accordance with movement or the like of the corresponding player character.

Each sound source object data set 89 is a data set regarding the sound source object. A plurality of sound source object data sets 89 are stored in the memory 12. FIG. 13 is a diagram showing an example of the configuration of each sound source object data set 89. The sound source object data set 89 includes an object ID 891, object position data 892, corresponding sound identification data 893, sound characteristic data 894, and the like.

The object ID 891 is an ID for identifying each sound source object. The object position data 892 is data representing the position of the sound source object within the virtual space. The corresponding sound identification data 893 is data representing the game audio data 84 that is defined as a sound emitted by the sound source object. The sound characteristic data 894 is data that defines, for example, the loudness (sound volume) of the sound emitted by the sound source object and the distance which the sound reaches within the virtual space.

Next, flow of the game process performed by the CPU 11 of the game apparatus body 5 on the basis of the game process program 81 will be described with reference to a flowchart of FIG. 14. It is noted that here, the above-described process regarding sound output control for the sound source object 105 will be mainly described, and the description of the other processes is omitted. In addition, the flowchart of FIG. 14 is repeatedly executed on a frame-by-frame basis. Moreover, here, a plurality of sound source objects 105 are located within the virtual space.

Figure 14:
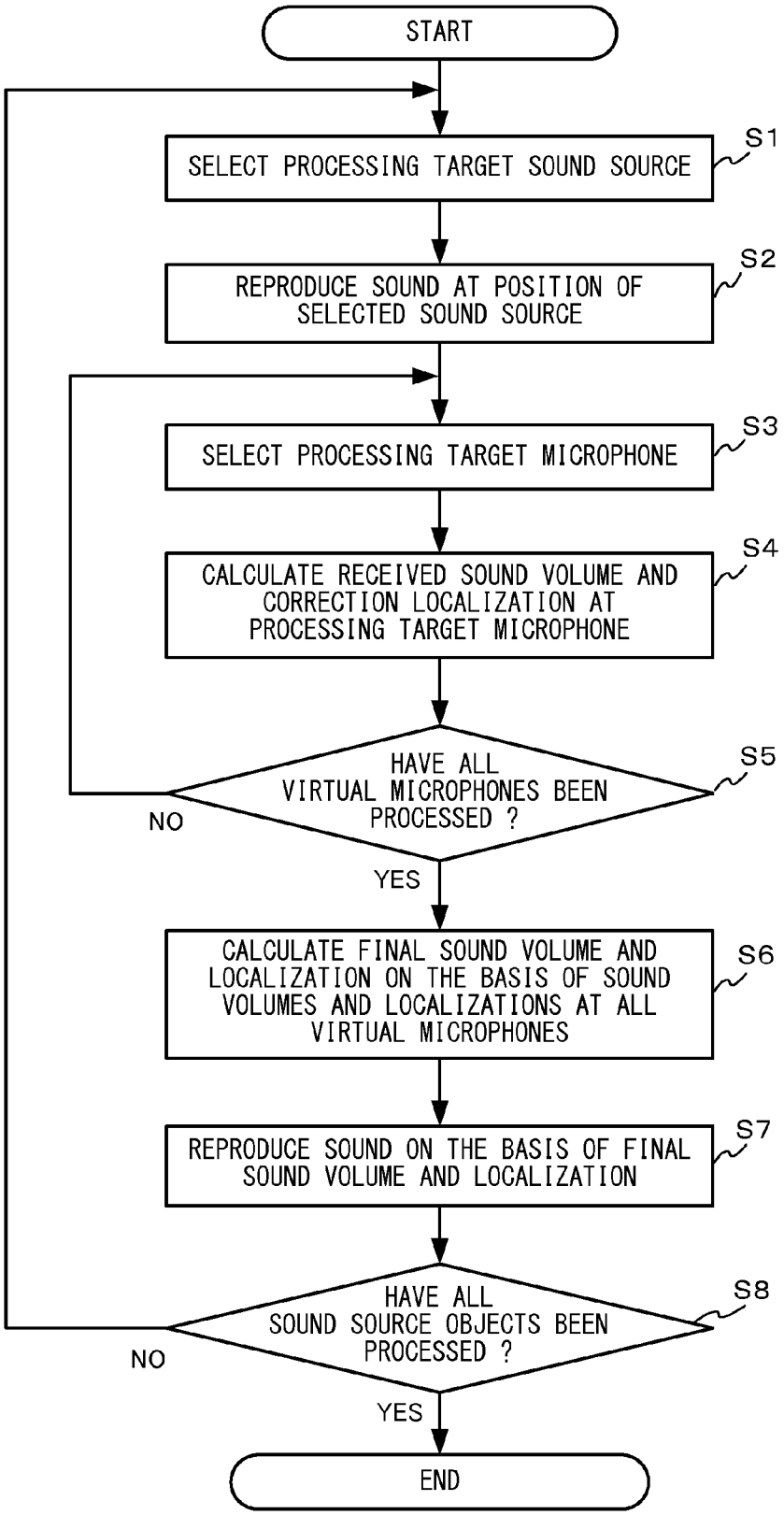
FIG. 14 is a flowchart showing flow of a game process based on a game process program 81.

In FIG. 14, first, in step S1, the CPU 11 selects one sound source object as a target of the process described below from among the plurality of sound source objects present within the virtual space. Hereinafter, the selected sound source object is referred to as processing target sound source.

Next, in step S2, the CPU 11 performs a process of reproducing a sound corresponding to the processing target sound source, from the position of the processing target sound source. In other words, the CPU 11 reproduces the game audio data 84 represented by the corresponding sound identification data 893 in accordance with the loudness of the sound represented by the sound characteristic data 894 at the position, within the virtual space, represented by the object position data 892.

Next, in step S3, the CPU 11 selects one virtual microphone (hereinafter, referred to as processing target microphone) as a target of the process below. Since the case of two virtual microphones is described in the present embodiment, the first virtual microphone is initially selected as a processing target microphone, and then the second virtual microphone is selected.

Next, in step S4, the CPU 11 performs a process of receiving the sound of the processing target sound source with the processing target microphone and calculating the received sound volume and the above-described correction localization. Specifically, first, the CPU 11 calculates the received sound volume at the processing target microphone on the basis of the distance between the processing target sound source and the processing target microphone and data representing the distance which the reproduced sound represented by the sound characteristic data 894 reaches. It is noted that when an object or the like is present as an obstacle between the processing target microphone and the processing target sound source, decrease of the sound volume by the obstacle and the like are also taken into consideration as appropriate. In addition, the sound volume is represented by a value within the range of 0.0 to 1.0. Next, the CPU 11 calculates the localization of the processing target sound source in the same manner as that for the case where the screen is not split, namely, the game screen is displayed as a single screen, as described above. The calculated localization is a value within the range of −1.0 to 1.0. Subsequently, the CPU 11 performs correction of the localization in consideration of the split screens as described. In other words, the CPU 11 performs calculation of the above-described correction localization. Thus, the received sound volume and the correction localization at the processing target microphone are calculated.

Next, in step S5, the CPU 11 determines whether or not the above-described calculation of the received sound volume and the correction localization has been performed for all the virtual microphones. As a result, when an unprocessed virtual microphone still remains (No in step S5), the CPU 11 returns to step S3 and repeats the same process.

On the other hand, when all the virtual microphones have been processed (YES in step S5), the CPU 11 calculates, in the subsequent step S6, a sound volume (final output sound volume) and a localization (final output localization) of a sound to be finally outputted, on the basis of the received sound volume and the correction localization at each virtual microphone. Specifically, the CPU 11 sets, as the final output sound volume, a greater received sound volume among the received sound volumes at the first virtual microphone 111 and the second virtual microphone 112. Furthermore, the CPU 11 calculates the final output localization by using the following formula. In the following formula, the received sound volume at the first virtual microphone is referred to as "first sound volume", and the correction localization at the first virtual microphone is referred to as "first localization". In addition, the received sound volume at the second virtual microphone is referred to as "second sound volume", and the correction localization at the second virtual microphone is referred to as "second localization".

[Math. 1]

$$\frac{(\text{first sound volume} \times \text{first localization}) + (\text{second sound volume} \times \text{second localization})}{(\text{first sound volume} + \text{second sound volume})} \quad \text{formula 1}$$

By such calculation, the final sound volume and localization can be determined such that a great weight is assigned for the localization range for the split screen in which the sound from the sound source object 105 reaches as a louder sound.

Next, in step S7, the CPU 11 reproduces the final sound of the processing target sound source on the basis of the final output sound volume and localization calculated in step S6.

Next, in step S8, the CPU 11 determines whether or not the above-described process has been performed for all the sound source objects present within the virtual space. As a result, when unprocessed sound source objects still remain (NO in step S8), the CPU 11 returns to step S1 and repeats the same process. On the other hand, when all the sound source objects have been processed (YES in step S8), the sound output control process is ended.

As described above, in the present embodiment, when a plurality of virtual microphones pick up a sound from the same sound source, importance is placed on the sound localization at the virtual microphone that receives the sound from the sound source as a louder sound, and a process is performed such that sound output is performed with a single sound. By so doing, it is possible to reproduce a sound such that the localization is biased to the split screen side in which the sound source is closer, in a game that is played with the screen of a single display device being split. As a result, even with representation with only a single sound, the sound is allowed to be heard in a natural manner. In addition, each player is allowed to easily recognize whether the sound source is close to or far from the own player character.

In the present embodiment, it is determined which of the localizations at the virtual microphones a weight is assigned to, on the basis of "the loudness of the sound picked up by each virtual microphone", not on the basis of "the distance" between each virtual microphone and the sound source object. Thus, for example, in the case where an obstacle that blocks sound is present between the virtual microphone and the sound source (including the possibility that it is made difficult to grasp a sense of perspective due to this), it is possible to accurately represent the situation within the virtual space with sound.

Although the case of splitting the screen into two screens has been described above as an example, the number of screens into which the screen is split is not limited to two. For example, the above-described process is also applicable to a case where the screen is laterally split into three or four screens. In such a case, virtual microphones whose number is equal to the number of the split screens may be prepared. In the process in step S6, the final output sound volume and the final output localization may be calculated on the basis of the received sound volumes and the correction localizations for all the virtual microphones.

In the above embodiment, sound output is performed by the speakers 2L and 2R of the monitor 2. In addition, for example, the above-described process is also applicable to a case where a 5.1 ch surround speaker is used instead of the speakers 2L and 2R of the monitor 2. In such a case, in addition to the localization in the x-axis direction in the local coordinate system for the virtual microphone as in the above-described process, a localization in the depth direction, namely, the z-axis direction in the local coordinate system for the virtual microphone may also be taken into consideration. For example, a localization range is set such that the position of a player is at 0.0, a range of 0.0 to 1.0 is set for the front of the player, and a range of −1.0 to 0.0 is set for the rear of the player. The localization may be two-dimensionally adjusted on an xz plane. In other words, sound output control may be performed by using both a localization in the x-axis direction and a localization in the z-axis direction.

In addition, for example, two pairs of stereo speakers may be arranged such that one pair is aligned along the right-left direction and the other pair is aligned along the up-down direction, and the above-described process may be applied thereto. In other words, localizations in the right-left direction and the up-down direction may be calculated through the above-described process. This is effective, for example, for the case where the screen is split into upper-half and lower-half screens or is split into four screens in a 2×2 vertical and horizontal arrangement.

In addition, the above-descried process is also applicable to a game that is played using merely sound output without using the monitor 2. For example, the game is such that a scene in which no image appears on the game screen is provided during a game process. For example, such a scene is a scene in which a player character is located in a cave where no light reaches. In such a scene, a game screen is displayed as a black screen in which nothing appears, and sound output is performed in consideration of the first localization range and the second localization range as described above. By so doing, each of players (they preferably play the game side by side) plays the game by depending on only sound, and thus it is possible to provide a new way to enjoy a game.

The game process program for performing the process according to the above embodiment can be stored in any computer-readable storage medium (e.g., a flexible disc, a hard disk, an optical disc, a magneto-optical disc, a CD-ROM, a CD-R, a magnetic tape, a semiconductor memory card, a ROM, a RAM, etc.).

In the above embodiment, the game process has been described as an example. However, the content of information processing is not limited to the game process, and the process according to the above embodiment is also applicable to other information processing in which a screen is split and a situation of a virtual three-dimensional space is displayed thereon.

In the above embodiment, a series of processes for controlling calculation of a localization and a sound volume of a sound to be finally outputted, on the basis of the positional relations between a certain single sound source object and a plurality of virtual microphones and sounds received by the virtual microphones, is performed in a single apparatus (the game apparatus body 5). In another embodiment, the series of processes may be performed in an information processing system that includes a plurality of information processing apparatuses. For example, in an information processing system that includes a game apparatus body 5 and a server side apparatus communicable with the game apparatus body 5 via a network, a part of the series of processes may be performed by the server side apparatus. Alternatively, in the information processing system, a server side system may include a plurality of information processing apparatuses, and a process to be performed in the server side system may be divided and performed by the plurality of information processing apparatuses.

What is claimed is:

1. A game system which includes a sound output section configured to output a sound based on an audio signal and which represents a virtual three-dimensional space in which a plurality of virtual microphones and at least one sound source object associated with predetermined audio data are located, the game system comprising:

a sound reproducer configured to reproduce a sound based on the predetermined audio data associated with the sound source object, at a position of the sound source object in the virtual three-dimensional space;

a received sound volume calculator configured to calculate, for each of the plurality of virtual microphones, a magnitude of a sound volume of the sound, reproduced by the sound reproducer, at each virtual microphone when the sound is received by each virtual microphone;

a first localization calculator configured to calculate, for each of the plurality of virtual microphones, a localization of the sound, reproduced by the sound reproducer, as a first localization when the sound is received by each virtual microphone;

a second localization calculator configured to calculate a localization of a sound to be outputted to the sound output section as a second localization on the basis of the magnitude of the sound volume of the sound regarding the sound source object at each virtual microphone which is calculated by the received sound volume calculator and the localization at each virtual microphone which is calculated by the first localization calculator;

a sound output controller configured to generate an audio signal regarding the sound source object on the basis of the second localization calculated by the second localization calculator and to output the audio signal to the sound output section;

a display section; and a display controller configured to split a display area included in a display screen displayed on the display section into split regions whose number is equal to the number of players who participate in a game and to display an image representing a situation within the virtual three-dimensional space, on the split region assigned to each player, wherein each virtual microphone is associated with any of the split regions and has a sound localization range corresponding to the associated split region, and the first localization calculator calculates the first localization by using the sound localization range corresponding to the split region associated with each virtual microphone.

2. The game system according to claim 1, wherein the display controller splits the display area such that the split regions are aligned along a lateral direction.

3. The game system according to claim 1, wherein the second localization calculator calculates the second localization such that a weight assigned to the first localization at the virtual microphone having the greatest magnitude of the sound volume which is calculated by the received sound volume calculator is increased.

4. The game system according to claim 1, further comprising an output sound volume setter configured to set, as a sound volume of a sound to be outputted to the sound output section, the greatest sound volume among the sound volume at each virtual microphone which is calculated by the received sound volume calculator, wherein the sound output controller outputs the sound based on the audio signal with the sound volume set by the output sound volume setter.

5. The game system according to claim 1, wherein a plurality of the sound source objects are located in the virtual three-dimensional space, the received sound volume calculator calculates, for each virtual microphone, a magnitude of a sound volume of a sound regarding each of the plurality of the sound source objects at each virtual microphone, the first localization calculator calculates, for each virtual microphone, the first localization regarding each of the plurality of the sound source objects, the second localization calculator calculates, for each virtual microphone, the second localization regarding each of the plurality of the sound source objects, and the sound output controller generates an audio signal based on the second localization regarding each of the plurality of the sound source objects.

6. The game system according to claim 1, wherein the sound output section is a stereo speaker, and each of the first localization calculator and the second localization calculator calculates a localization in a right-left direction when a player facing the sound output section sees the sound output section.

7. The game system according to claim 1, wherein the sound output section is a surround speaker, and each of the first localization calculator and the second localization calculator calculates a localization in a right-left direction and a localization in a forward-rearward direction when a player facing the sound output section sees the sound output section.

8. A game process control method for controlling a game system which includes a sound output section configured to output a sound based on an audio signal and which represents a virtual three-dimensional space in which a plurality of virtual microphones and at least one sound source object associated with predetermined audio data, the game process control method comprising the steps of:

reproducing a sound based on the predetermined audio data associated with the sound source object, at a position of the sound source object in the virtual three-dimensional space;

calculating, for each of the plurality of virtual microphones, a magnitude of a sound volume of the sound, reproduced in the sound reproducing step, at each virtual microphone when the sound is received by each virtual microphone;

calculating, for each of the plurality of virtual microphones, a localization of the sound, reproduced in the sound reproducing step, as a first localization when the sound is received by each virtual microphone;

calculating a localization of a sound to be outputted to the sound output section as a second localization on the basis of the magnitude of the sound volume of the sound regarding the sound source object at each virtual microphone which is calculated in the received sound volume calculating step and the localization at each virtual microphone which is calculated in the first localization calculating step; and generating an audio signal regarding the sound source object on the basis of the second localization calculated in the second localization calculating step and outputting the audio signal to the sound output section, wherein the game system further includes a display section, the game process control method further comprises the step of splitting a display area included in a display screen displayed on the display section into split regions whose number is equal to the number of players who participate in a game and displaying an image representing a situation within the virtual three-dimensional space, on the split region assigned to each player, each virtual microphone is associated with any of the split regions and has a sound localization range corresponding to the associated split region, and in the first localization calculating step, the first localization is calculated by using the sound localization range corresponding to the split region associated with each virtual microphone.

9. The game process control method according to claim 8, wherein, in the audio signal generating and outputting step, the display area is split such that the split regions are aligned along a lateral direction.

10. The game process control method according to claim 8, wherein, in the second localization calculating step, the second localization is calculated such that a weight assigned to the first localization at the virtual microphone having the greatest magnitude of the sound volume which is calculated in the received sound volume calculating step is increased.

11. The game process control method according to claim 8, further comprising the step of setting, as a sound volume of a sound to be outputted to the sound output section, the greatest sound volume among the sound volume at each virtual microphone which is calculated in the received sound volume calculating step, wherein in the audio signal generating and outputting step, the sound based on the audio signal with the sound volume set in the sound volume setting step is outputted.

12. The game process control method according to claim 8, wherein a plurality of the sound source objects are located in the virtual three-dimensional space, in the received sound volume calculating step, a magnitude of a sound volume of a sound regarding each of the plurality of the sound source objects at each virtual microphone is calculated for each virtual microphone, in the first localization calculating step, the first localization regarding each of the plurality of the sound source objects is calculated for each virtual microphone, in the second localization calculating step, the second localization regarding each of the plurality of the sound source objects is calculated for each virtual microphone, and in the audio signal generating and outputting step, an audio signal based on the second localization regarding each of the plurality of the sound source objects is generated.

13. The game process control method according to claim 8, wherein the sound output section is a stereo speaker, and in each of the first localization calculating step and the second localization calculating step, a localization in a right-left direction when a player facing the sound output section sees the sound output section is calculated.

14. The game process control method according to claim 8, wherein the sound output section is a surround speaker, and in each of the first localization calculating step and the second localization calculating step, a localization in a right-left direction and a localization in a forward-rearward direction when a player facing the sound output section sees the sound output section are calculated.

15. A game apparatus which includes a display section, a processor system including at least one processor, a sound output section configured to output a sound based on an audio signal and which represents a virtual three-dimensional space in which a plurality of virtual microphones and at least one sound source object associated with predetermined audio data are located, the processor system being configured to at least:

reproduce a sound based on the predetermined audio data associated with the sound source object, at a position of the sound source object in the virtual three-dimensional space;

calculate, for each of the plurality of virtual microphones, a magnitude of a sound volume of the reproduced sound, at each virtual microphone when the sound is received by each virtual microphone;

calculate, for each of the plurality of virtual microphones, a localization of the reproduced sound, as a first localization when the sound is received by each virtual microphone;

calculate a localization of a sound to be outputted to the sound output section as a second localization on the basis of the calculated magnitude of the sound volume of the sound regarding the sound source object at each virtual microphone and the calculated localization at each virtual microphone;

generate an audio signal regarding the sound source object on the basis of the calculated second localization and to output the audio signal to the sound output section; and split a display area included in a display screen displayed on the display section into split regions whose number is equal to the number of players who participate in a game and to display an image representing a situation within the virtual three-dimensional space, on the split region assigned to each player, wherein each virtual microphone is associated with any of the split regions and has a sound localization range corresponding to the associated split region, and the first localization is calculated by using the sound localization range corresponding to the split region associated with each virtual microphone.

16. A computer-readable non-transitory storage medium having stored therein a game program executed by a computer of a game system or game apparatus which includes a sound output section configured to output a sound based on an audio signal and which represents a virtual three-dimensional space in which a plurality of virtual microphones and at least one sound source object associated with predetermined audio data are located, the game program causing the computer to operate as:

a sound reproducer configured to reproduce a sound based on the predetermined audio data associated with the sound source object, at a position of the sound source object in the virtual three-dimensional space;

a received sound volume calculator configured to calculate, for each of the plurality of virtual microphones, a magnitude of a sound volume of the sound, reproduced by the sound reproducer, at each virtual microphone when the sound is received by each virtual microphone;

a first localization calculator configured to calculate, for each of the plurality of virtual microphones, a localization of the sound, reproduced by the sound reproducer, as a first localization when the sound is received by each virtual microphone;

a second localization calculator configured to calculate a localization of a sound to be outputted to the sound output section as a second localization on the basis of the magnitude of the sound volume of the sound regarding the sound source object at each virtual microphone which is calculated by the received sound volume calculator and the localization at each virtual microphone which is calculated by the first localization calculator;

a sound output controller configured to generate an audio signal regarding the sound source object on the basis of the second localization calculated by the second localization calculator and to output the audio signal to the sound output section;

a display section; and a display controller configured to split a display area included in a display screen displayed on the display section into split regions whose number is equal to the number of players who participate in a game and to display an image representing a situation within the virtual three-dimensional space, on the split region assigned to each player, wherein each virtual microphone is associated with any of the split regions and has a sound localization range corresponding to the associated split region, and the first localization calculator calculates the first localization by using the sound localization range corresponding to the split region associated with each virtual microphone.

* * * * *